US007887335B2

(12) United States Patent
Morley

(10) Patent No.: US 7,887,335 B2
(45) Date of Patent: Feb. 15, 2011

(54) RF ELECTRONIC SYSTEM AND CONNECTION ASSEMBLY THEREFORE

(75) Inventor: Stephen T Morley, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/422,838

(22) Filed: Apr. 13, 2009

(65) Prior Publication Data

US 2010/0261356 A1 Oct. 14, 2010

(51) Int. Cl.
*H01R 12/00* (2006.01)

(52) U.S. Cl. ..... 439/63; 439/79

(58) Field of Classification Search ..... 439/62–63, 439/79, 581

See application file for complete search history.

(56) References Cited

U.S. PATENT DOCUMENTS

| | | | | |
|---|---|---|---|---|
| 4,674,809 | A | 6/1987 | Hollyday et al. | |
| 5,046,952 | A * | 9/1991 | Cohen et al. | 439/63 |
| 5,186,635 | A | 2/1993 | Pechulis et al. | |
| 5,397,241 | A * | 3/1995 | Cox et al. | 439/79 |
| 6,123,587 | A | 9/2000 | Beloritski et al. | |
| 6,224,421 | B1 | 5/2001 | Maturo, Jr. | |
| 7,481,673 | B1 | 1/2009 | Qu et al. | |
| 7,500,855 | B2 * | 3/2009 | Kari | 439/63 |
| 2002/0176240 | A1 | 11/2002 | Hudson et al. | |
| 2002/0177332 | A1 | 11/2002 | Hubbard et al. | |
| 2008/0102654 | A1 | 5/2008 | Kari | |

FOREIGN PATENT DOCUMENTS

DE 20 2007 008 847 8/2007

OTHER PUBLICATIONS

Delta Electronics Manufacturing, "SMA Receptacles, Edge Mount P.C. Board Receptacles—Bulkhead Jack", 1 page.
Emerson Network Power, "Johnson High Frequency End Launch Connectors", pp. 1-13.
Southwest Microwave, Inc., "End Launch Connector Series", pp. 59-65.
Tyco Electronics Corporation, SMA Stripline End Launch Jack-Tab Terminal, Drawing No. C-1053476.
International Search Report, International Application No. PCT/US2010/001082, International Filing Date Dec. 4, 2010.

* cited by examiner

*Primary Examiner*—Khiem Nguyen

(57) ABSTRACT

An electronic system is disclosed for RF signals, and comprises coaxial interconnection systems for interconnection with a printed circuit board and which provides an interface with the printed circuit boards.

12 Claims, 5 Drawing Sheets

RF ELECTRONIC SYSTEM AND CONNECTION ASSEMBLY THEREFORE

RELATED APPLICATIONS

This application is related to U.S. patent application Ser. No. 12/442,837, filed on Monday Apr. 13, 2009 (the subject matter of which is incorporated herein by reference).

FIELD OF THE INVENTION

The subject disclosure relates to a coaxial style connection system for interconnecting circuit boards and providing an interface for, printed circuit boards within an electronic module.

BACKGROUND OF THE INVENTION

Many different styles of connection systems are used to transmit radio frequency (RF) signals in any of cable-to-cable connections, board-to-board connections or board-to-cable connections. Some of the connection systems are part of an electronic system comprised of an enclosure with an opening therethrough. Typically the systems are built with multiple interconnections, and sometimes with cabling extending through an interface to the internal components. It would therefore be desirable to simplify the assembly and provide less interconnections.

The object of the present embodiment is to improve upon the simplicity of the design and/or to improve upon the electronic performance.

SUMMARY OF THE INVENTION

In one embodiment, an electrical connector assembly comprises an electronic system having an enclosure with a plurality of walls and a housing module, connected to at least a portion of one of the walls and forming at least a portion of one of the walls. At least a portion of the module extending into an interior of the enclosure and at least one contact assembly is positioned in the housing module and having a first interface from an exterior of the enclosure, and a second interface from an interior of the enclosure. At least one printed circuit board is mounted to the housing module and within the enclosure; and at least one mating contact is directly connected to the at least one printed circuit board and electrically connected to the at least one contact assembly at the second interface.

In another embodiment, an electrical connector assembly comprises an electrical connector assembly comprising a housing module having a mating face and a second face, at least receiving opening extending between the mating face and second face. An extension wall extends from the second face. At least one contact assembly is positioned in the housing module and has a first interface adjacent the mating face and a second interface adjacent the extension wall. An attachment member is provided for attaching a printed circuit board to the extension wall.

DETAILED DESCRIPTION

Figure 1:
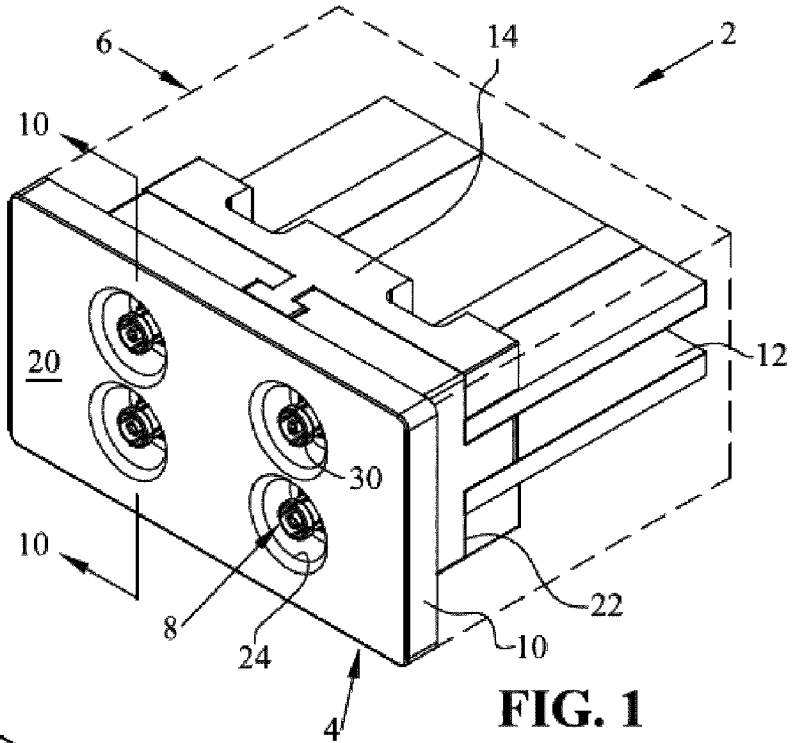
FIG. 1 discloses a front perspective view of an electronic system assembly.
Figure 2:
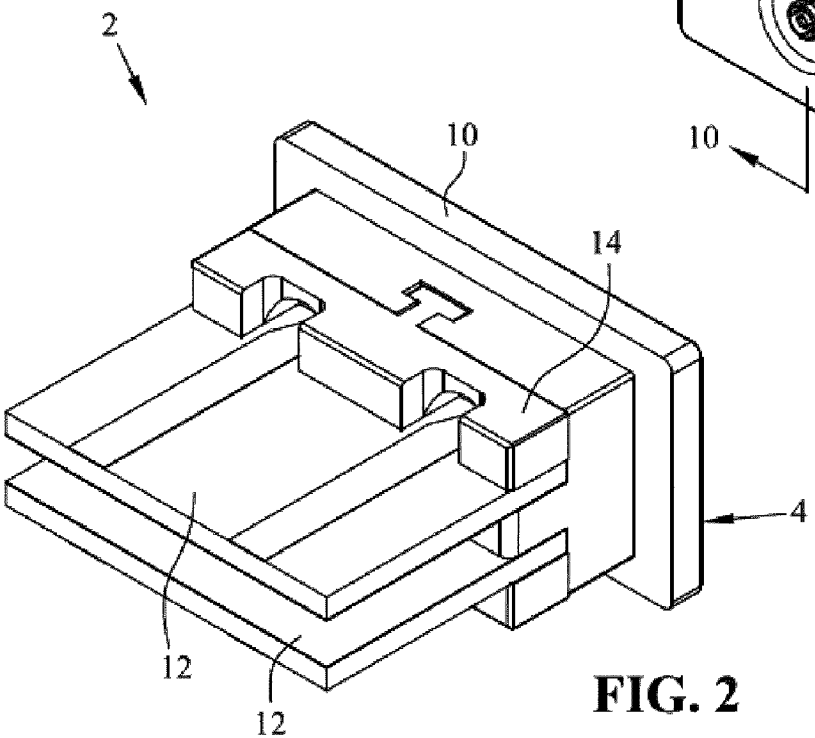
FIG. 2 discloses a rear perspective view of the connector assembly for use with the electronic system assembly of FIG. 1.

With reference first to FIGS. 1 and 2, an electronic system assembly is shown at 2 comprising a connector assembly 4 and an outer housing enclosure 6. As shown, connector assembly 4 is comprised of a coaxial plug contact assembly 8 and a housing module 10. Housing enclosure 6 is shown diagrammatically in FIG. 1 as a rectangular box but could be any configuration, but may include a plurality of walls and an opening through at least a portion of one wall, where the housing module 10 may be connected to at least a portion of one wall and form at least a portion of one wall, and where at least a portion of the housing module 10 extends into the enclosure 6. As shown, connector assembly 4 is interconnected to a plurality of printed circuit boards 12. Connector assembly 4 further comprises attachment members 14 which retain the printed circuit boards 12 to the housing module 10, as described herein.

Figure 3:
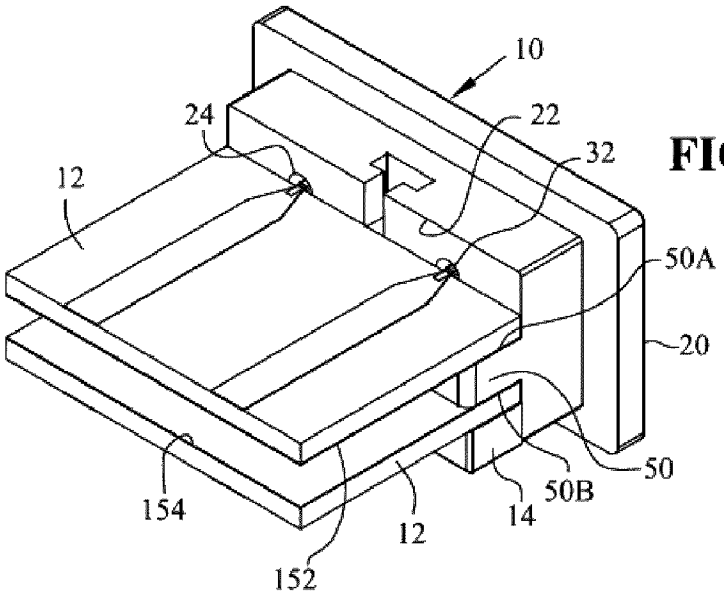
FIG. 3 discloses a rear perspective view of the partially assembled connector assembly.

With respect to FIGS. 1 and 3, connector housing module 10 includes a first or front face 20 and a second or rear face 22 with receiving openings 24 extending between the first and second faces 20, 22. As shown best in FIG. 1, coaxial plug contact assembly 8 is shown having a first contact interface 30 positioned adjacent to first face 20 and as best shown in FIG. 3 has a second contact interface 32 positioned adjacent to second face 22.

Figure 7:
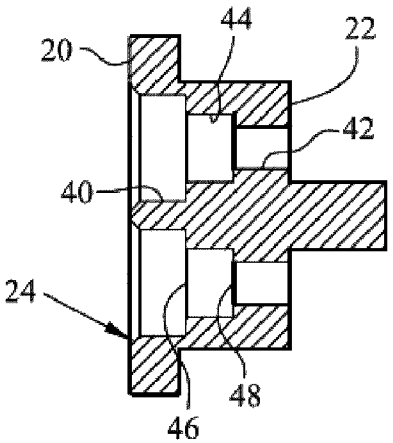
FIG. 7 discloses a cross-sectional view through lines 7-7 of FIG. 5.
Figure 6:
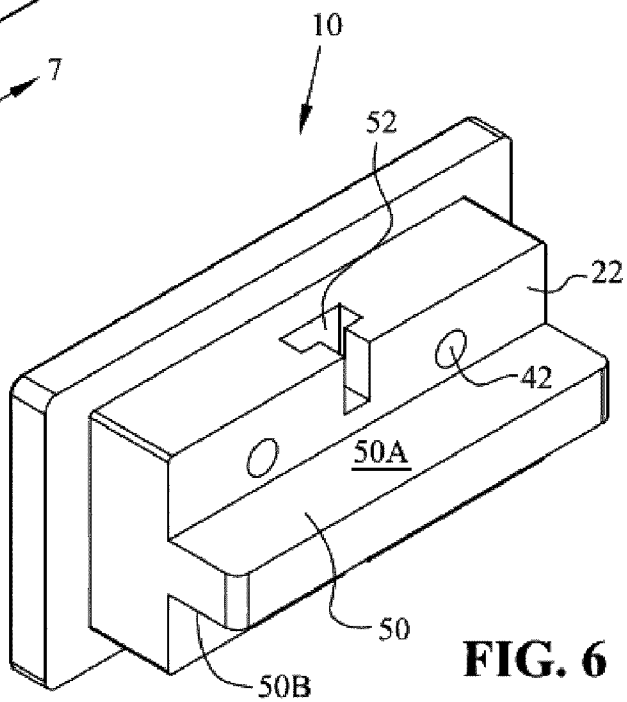
FIG. 6 discloses a rear perspective view of the housing module of FIG. 4.
Figure 5:
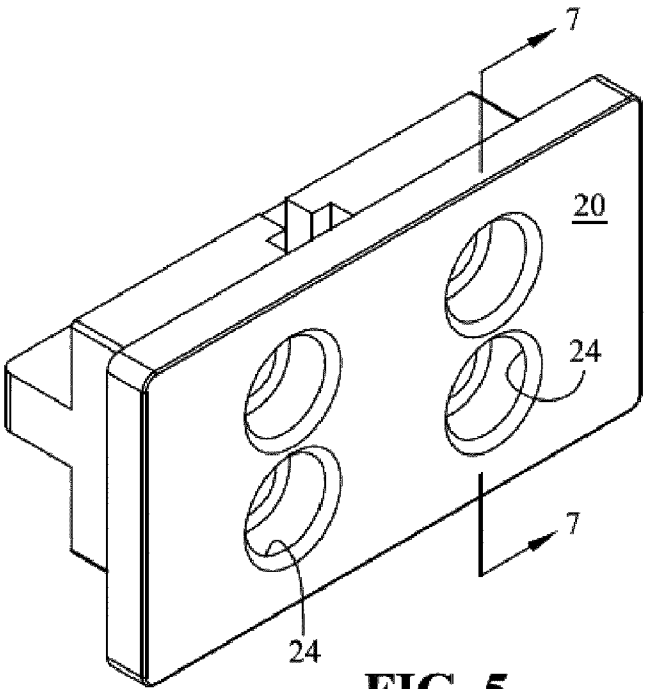
FIG. 5 discloses a front perspective view of the housing module.

As shown best in FIGS. 4-7, the receiving openings 24 are defined by a bored hole extending inwardly from the first face 20 and as best shown in FIG. 7, defines an enlarged opening portion 40, a constricted opening portion 42, and an intermediate opening portion at 44. Enlarged opening portion 40 opens onto first face 20 and constricted opening portion 42 opens onto second face 22. The intersection of enlarged opening portion 40 and intermediate opening portion 44 defines shoulder 46, while the intersection of intermediate opening portion 44 and constricted opening portion 42 defines shoulder 48. With respect to FIG. 6, housing module 10 further comprises a mounting portion in the form of an extension wall 50, and has an upper contact surface 50A and a lower contact surface 50B. Housing module 10 further includes a T-shaped groove 52 extending downwardly intermediate a top row of receiving openings 24, and a bottom T-shaped groove 52 (not shown) extending upwardly towards extension wall 50.

Figure 8:
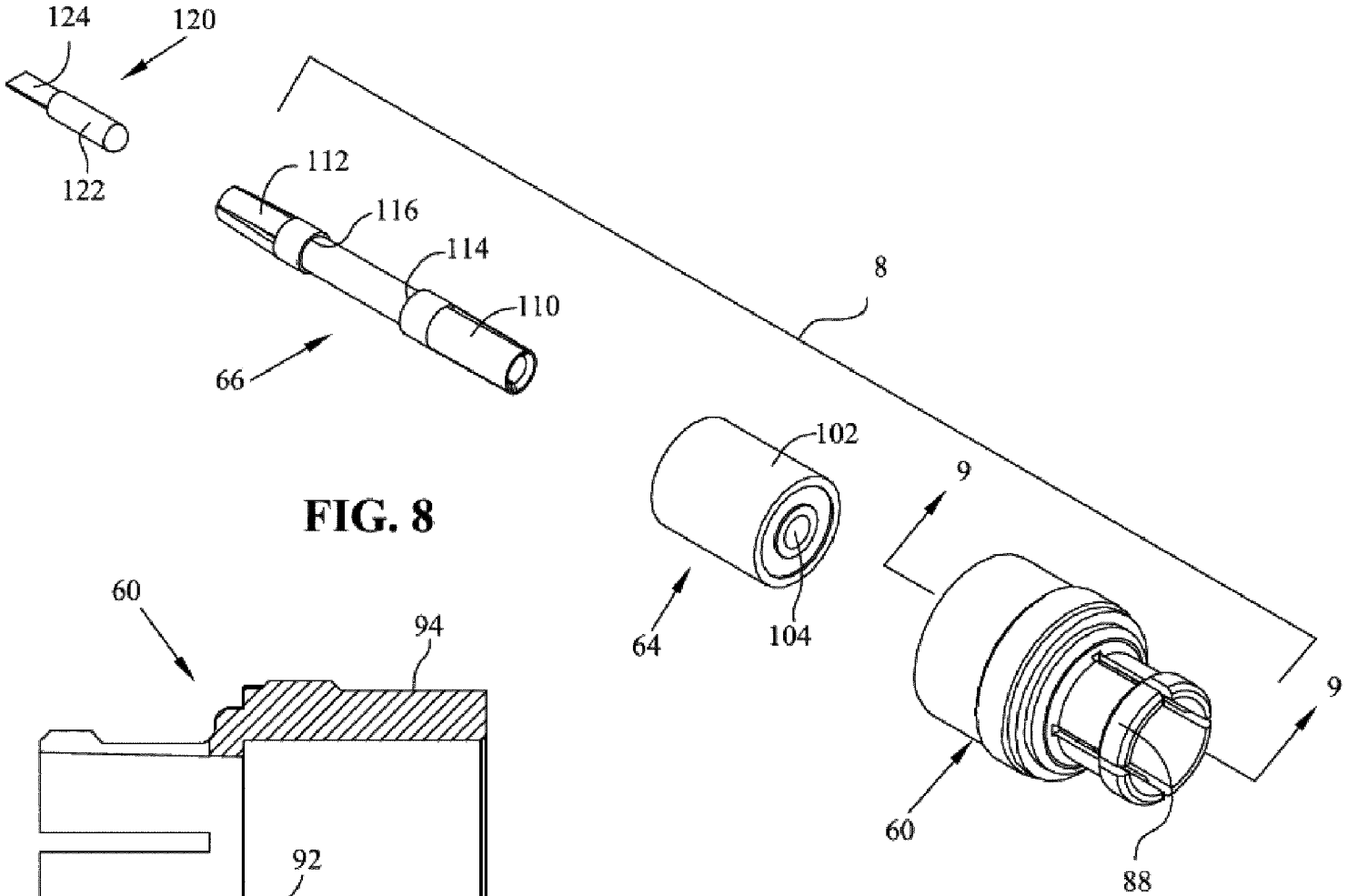
FIG. 8 discloses an exploded view of the coaxial plug contact assembly.
Figure 9:
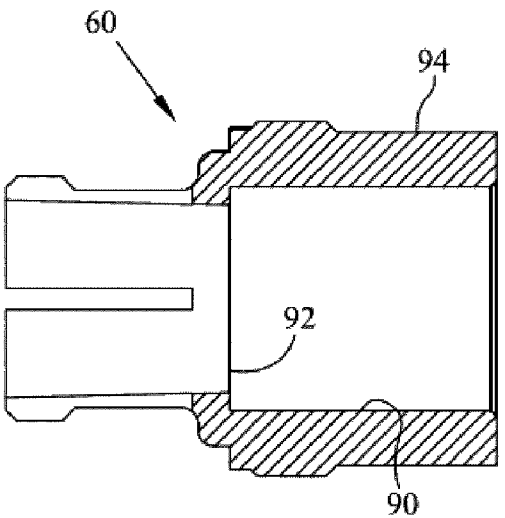
FIG. 9 is a cross-sectional view through lines 9-9 of FIG. 8.

With respect now to FIGS. 4, 8 and 9 coaxial plug contact assembly 8 will be described in greater detail. With respect first to FIG. 4, coaxial plug contact assembly 8 is shown exploded from housing module 10. Coaxial plug contact assembly 8 is comprised of plug housing portion 60, insulators 64 and socket contacts 66. With reference now to FIGS.

8 and 9, plug housing portion 60 further includes a plurality of ground contacts 88 where the plug housing portion 60 is comprised of a conductive material such as a metal. As shown best in FIG. 9, plug housing portion 60 further includes an inner diameter at 90 defining a rearwardly facing shoulder at 92, and an outer diameter at 94. With reference to FIG. 8, insulator 64 includes an outer diameter at 102 and an internal opening at 104. Socket contact 66 includes a first socket portion 110, a second socket portion 112, and first and second shoulders 114, 116. A mating pin 120 includes a pin portion 122 and a tab portion 124.

With reference again to FIG. 4, attachment members 14 include a bar portion 130 with a T-shaped tongue 132 extending therefrom. T-shaped tongue 132 corresponds with T-shaped groove 52 for positioning the attachment members 14 proximate to the extension wall 50, as described herein. Semi-circular clearance openings 134 are provided adjacent a contact surface 136 of the attachment members 14 as described herein.

Figure 10:
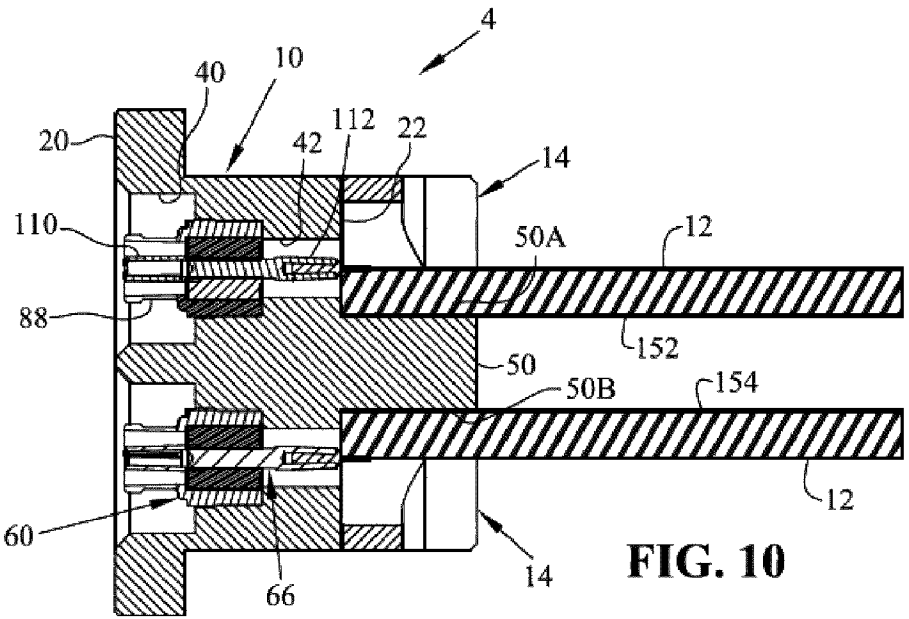
FIG. 10 discloses a cross-sectional view through lines 10-10 of FIG. 1.

The assembly of the connector plug assembly 4 is as follows. With respect again to FIG. 8, the assembly of coaxial plug contact assembly 8 will be described. Socket contact 66 is first inserted into opening 104 such that insulator 64 is trapped between shoulders 114, 116 of socket contacts 66. The combination of the insulator 64 and socket contact 66 is then inserted into the inner diameter 90 (FIG. 9) of the plug housing portion 60 until insulator 64 abuts shoulder 92. Plug housing portion 60, together with insulator 64 and socket contact 66, can then be positioned into receiving opening 24 (and more particularly through enlarged opening portion 40) such that outer diameter 94 (FIG. 9) of plug housing 60 is received within intermediate opening 44 (FIG. 7) of housing module 10. As shown in FIG. 10, this positions ground contacts 88 and first socket contact 110 within enlarged opening portion 40, and positions second socket contact 112 within constricted opening portion 42. It should be understood that the connection between plug housing portion 60 and housing module 10 is a semi-permanent connection and can be made by known means such as interference fit, soldering, sweat fitting, threadable connection, or the like. When in position, insulator 64 also abuts shoulder 48 (FIG. 7) to trap socket contact 66 in position within receiving opening 24.

Figure 4:
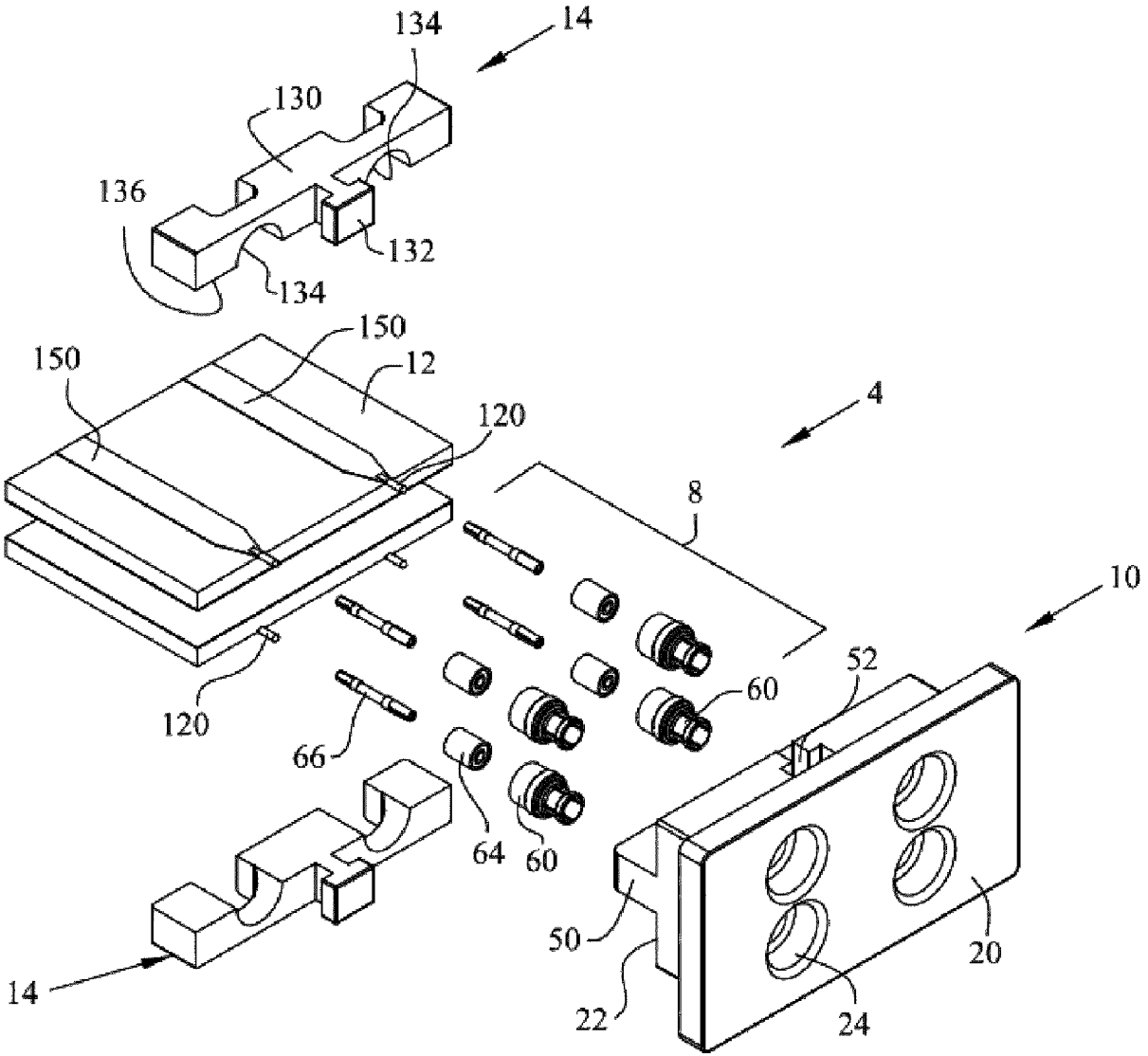
FIG. 4 discloses an exploded view of the connector assembly of FIG. 2.

With reference again to FIG. 8, mating pins 120 may now be attached to printed circuit board 12, such that a tab portion 124 is attached to each trace 150 on printed circuit board 12, as shown in FIG. 4. This also positions pin portions 122 extending outwardly from printed circuit board 12. The upper printed circuit board 12 may now be positioned on upper contact surface 50A of extension wall 50, with pin portions 122 plugged into second socket portions 112, as shown best in FIG. 3. The backside 152 of printed circuit board 12 is therefore in contact with surface 50A of the extension wall 50, and as shown, backside 152 comprises a ground plane comprised of a metallized layer. As the housing module 10 is conductive, for example, comprised of steel, the contact between the backside 152 and the extension wall 50, together with the contact between plug housing portion 60 and intermediate opening portion 44, forms a ground path between the board and the coaxial plug ground contacts 88.

The lower printed circuit board 12 is also positioned with an upper side 154 positioned against contact surface 50B of extension wall 50. Both attachment members 14 are positioned such the T-shaped tongue 132 (FIG. 4) positioned in the corresponding T-shaped groove 52. A clamping force is then asserted against the attachment members to force them in a direction towards the extension wall 50. In one embodiment fasteners could be positioned through apertures (not shown) in the bar portion 130 and could be threaded into threaded openings (not shown) into the contact surfaces 50A, 50B such that the printed circuit boards are drawn against the extension wall. Alternatively, a clamp (not shown) could be provided to pull the two attachment members towards each other and trap the printed circuit boards 12 against the extension wall 50.

As disclosed, the housing module 10 includes at least two rows and two columns of receiving openings 24, with the extension wall 50 positioned intermediate the two rows of receiving openings 24. A top row of the receiving openings 24, open onto a top surface 50A of the extension wall 50 and a bottom row of the receiving openings 24, open onto a bottom surface 50B of the extension wall 50. The housing module 10 is provided with a T-shaped groove 52 intermediate the two columns of receiving openings 24 and each of the attachment members 14 is provided with a complementary T-shaped tongue receivable in the housing module T-shaped groove.

Also as disclosed, an electronic system is shown where the housing module 10 forms at least a portion of one wall of the enclosure 6 (FIG. 1). The interface with the internal electronics (on the printed circuit boards 12) is provided directly at the housing module first face 20. Thus a mating jack (not shown) may be directly connected to the coaxial plug contact assembly 8, which in turn makes direct connection with the printed circuit board 12 and the associated circuitry.

Figure 11:
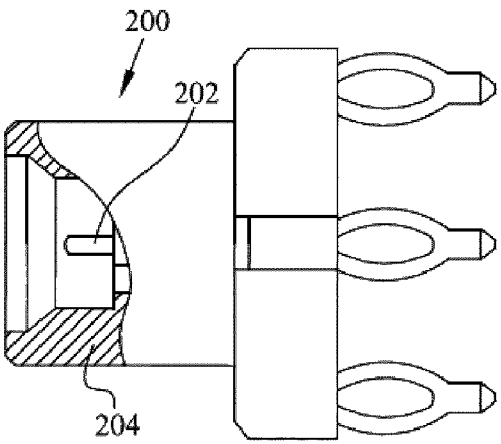
FIG. 11 shows one example of a mating connector for use with the electronic system assembly.

With reference now to FIG. 11, an embodiment of one possible mating receptacle is shown at 200, having a signal contact in the form of a pin 202, and an outer ground contact 204. Pin 202 would be cooperable with first socket portion 110 and outer ground contact 204 would cooperate with ground contacts 88. Multiple receptacles 200 could be positioned in a backplane arrangement, with the receptacles positioned in a like array as the coaxial plug contact assemblies 8, for interconnection therewith. Furthermore, or alternatively, a spring loaded contact assembly, for example, one similar to that disclosed in U.S. patent application Ser. No. 12/442,837, filed on Monday Apr. 13, 2009 (the subject matter of which is incorporated herein by reference) could be utilized.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An electrical connector assembly, comprising:

a housing module having a first face and a second face, at least one receiving opening extending between the first face and second faces;

an extension wall extending from the second face, having contact surfaces on an upper and lower surface thereof;

at least one contact assembly positioned in the housing module and having a first interface adjacent the first face and a second interface adjacent and spaced above the extension wall;

at least one contact assembly positioned in the housing module and having a first interface adjacent the first face and a second interface adjacent and spaced below the extension wall; and an attachment member for attaching a printed circuit board to the extension wall.

2. The electrical connector assembly of claim 1, wherein the first face is a front face and the second face is a rear face, the rear face opening on to the extension wall.

3. The electrical connector assembly of claim 2, wherein the housing module is conductive.

4. The electrical connector assembly of claim 2, wherein the contact assembly is a coaxial plug contact assembly having an outer ground contact and an inner signal contact.

5. The electrical connector assembly of claim 2, wherein the attachment member is profiled for clamping a printed circuit board to the extension wall.

6. The electrical connector assembly of claim 5, wherein the attachment member is attachable to the housing module.

7. The electrical connector assembly of claim 1, wherein the housing module comprises at least one receiving opening, with the outer ground contact and the inner signal contact positioned in a recessed manner within the receiving opening.

8. The electrical connector assembly of claim 7, wherein the housing module includes at least two rows and two columns of receiving openings, with the extension wall positioned intermediate the two rows of receiving openings, a top row of the at least two rows opening onto a top surface of the extension wall and a bottom row of the at least two rows opening onto a bottom surface of the extension wall.

9. The electrical connector assembly of claim 8, wherein a top and bottom surface of the housing module is provided with a groove intermediate the two columns of receiving openings and each of the housing attachment members is provided with a complementary tongue receivable in the housing module slot.

10. The electrical connector assembly of claim 7, wherein the housing module comprises a plurality of receiving openings, with the outer ground contact and an inner signal contact of each contact assembly recessed in each receiving opening.

11. The electrical connector assembly of claim 8, wherein the outer ground contacts and the inner signal contacts are positioned in a recessed manner within the receiving openings.

12. An electrical connector assembly, comprising:

a housing module having:

a first face and a second face;

an extension wall extending from the second face;

a plurality of receiving openings extending between the first face and second faces, including at least two rows and two columns of receiving openings, with the extension wall positioned intermediate the two rows of receiving openings, a top row of the at least two rows opening onto a top surface of the extension wall and a bottom row of the at least two rows opening onto a bottom surface of the extension wall; and a top and bottom surface of the housing module being provided with a groove intermediate the two columns of receiving openings;

at least one contact assembly positioned in the housing module and having a first interface adjacent the first face and a second interface adjacent the extension wall; and an attachment member for attaching each printed circuit board to the extension wall, each of the attachment members being provided with a complementary tongue receivable in a housing module slot.

* * * * *